US008480876B2

(12) United States Patent
Beck

(10) Patent No.: US 8,480,876 B2
(45) Date of Patent: Jul. 9, 2013

(54) ALUMINUM PRODUCTION CELL

(76) Inventor: Theodore R. Beck, Seattle, WA (US)

( * ) Notice: Subject to any disclaimer, the term of this patent is extended or adjusted under 35 U.S.C. 154(b) by 1500 days.

(21) Appl. No.: 12/005,087

(22) Filed: Dec. 26, 2007

(65) Prior Publication Data

US 2009/0166215 A1 Jul. 2, 2009

(51) Int. Cl.
*C25C 3/06* (2006.01)
*C25C 3/08* (2006.01)
*C25C 3/12* (2006.01)

(52) U.S. Cl.
USPC ..... 205/384; 204/245

(58) Field of Classification Search
USPC ..... 205/372–396; 204/242
See application file for complete search history.

(56) References Cited

U.S. PATENT DOCUMENTS

| | | | | |
|---|---|---|---|---|
| 4,338,177 | A * | 7/1982 | Withers et al. | 204/247.3 |
| 4,544,457 | A * | 10/1985 | Sane et al. | 205/350 |
| 4,560,448 | A | 12/1985 | Sane et al. | 204/67 |
| 4,865,701 | A | 9/1989 | Beck et al. | 204/67 |
| 5,006,209 | A | 4/1991 | Beck et al. | 204/67 |
| 5,284,562 | A | 2/1994 | Beck et al. | 204/243 |
| 5,498,320 | A | 3/1996 | Rendall | 205/385 |
| 5,578,174 | A | 11/1996 | Sekhar | 204/243 |
| 6,419,812 | B1 | 7/2002 | Beck et al. | 205/374 |
| 6,436,272 | B1 | 8/2002 | Brown et al. | 205/374 |
| 6,533,909 | B2 | 3/2003 | Duruz et al. | 204/243.1 |
| 6,811,676 | B2 | 11/2004 | Bradford et al. | 205/380 |
| 6,866,768 | B2 | 3/2005 | Bradford et al. | 205/376 |
| 2002/0125125 | A1 | 9/2002 | Rapp | |
| 2003/0057102 | A1 * | 3/2003 | Beck | 205/376 |

FOREIGN PATENT DOCUMENTS

| | | |
|---|---|---|
| WO | 2009310281 | 5/1993 |
| WO | 02070783 | 9/2002 |
| WO | 03062496 | 7/2003 |

* cited by examiner

*Primary Examiner* — Nicholas A Smith
*Assistant Examiner* — Ciel Thomas
(74) *Attorney, Agent, or Firm* — Andrew Alexander

(57) ABSTRACT

Low temperature cell for electrolytic production of aluminum.

56 Claims, 8 Drawing Sheets

ALUMINUM PRODUCTION CELL

BACKGROUND OF THE INVENTION

This invention relates to aluminum production and more particularly, it relates to smelting aluminum in a low temperature electrolytic production cell, for example.

In the present commercial technology Hall-Heroult cell, aluminum is collected in the bottom and is tapped periodically to remove the molten aluminum. In low temperature cells with vertical anodes and cathodes, the removal of molten aluminum has not been without problems. For example, in the low temperature cell where inert anodes and cathodes are used, $O_2$ is produced at the anode and the alumina is reduced to aluminum at the cathode. Because the electrolyte is saturated with alumina, alumina particles are present as a slurry and are very difficult to separate from the molten aluminum. Thus, there is a great need for a process that will separate the aluminum from the alumina particles and electrolyte and remove the aluminum from the cell.

It should be noted that U.S. Pat. Nos. 4,865,701 and 5,006,209, incorporated herein by reference, disclose a low temperature cell for making aluminum from a slurry of alumina present in the electrolyte. The overall reaction in the cell is $Al_2O_3$=2Al+3/2 $O_2$ producing $O_2$, as noted, rather than carbon dioxide.

U.S. Pat. No. 5,284,562, incorporated herein by reference, also describes an alumina slurry cell wherein an oxidation resistant, non-consumable anode, for use in the electrolytic reduction of alumina to aluminum, has a composition comprising copper, nickel and iron. The anode is part of an electrolytic reduction cell comprising a vessel having an interior lined with metal which has the same composition as the anode The electrolyte is preferably composed of a eutectic of $AlF_3$ and either (a) NaF or (b) primarily NaF with some of the NaF replaced by an equivalent molar amount of KF or KF and LiF.

U.S. Pat. No. 5,489,320 discloses an aluminum smelting by electrolysis, a double salt of $KAlSO_4$, as a feedstock, is heated with a eutectic electrolyte, such as $K_2$ $SO_4$, at 800° C. for twenty minutes to produce an out-gas of $SO_3$ and a liquid electrolyte of $K_2SO_4$ with fine-particles of $Al_2$ $O_3$ in suspension having a mean size of six to eight microns.

U.S. Pat. No. 6,811,676 discloses an electrolytic cell for producing aluminum from alumina having a reservoir for collecting molten aluminum remote from the electrolysis.

U.S. Pat. No. 6,866,768 discloses electrolysis of alumina dissolved in a molten salt electrolyte employing inert anode and cathodes, the anode having a box shape with slots for the cathodes.

U.S. Pat. No. 6,419,812 discloses a method of producing aluminum in an electrolytic cell containing alumina dissolved in an electrolyte. The method comprises the steps of providing a molten salt electrolyte in an electrolytic cell having an anodic liner for containing the electrolyte, the liner having an anodic bottom and walls including at least one end wall extending upwardly from the anodic bottom, the anodic liner being substantially inert with respect to the molten electrolyte. A plurality of non-consumable anodes is provided and disposed vertically in the electrolyte. A plurality of cathodes is disposed vertically in the electrolyte in alternating relationship with the anodes. The anodes are electrically connected to the anodic liner. An electric current is passed through the anodic liner to the anodes, through the electrolyte to the cathodes, and aluminum is deposited on said cathodes. Oxygen bubbles are generated at the anodes and the anodic liner, the bubbles stirring the electrolyte. Molten aluminum is collected from the cathodes into a tubular member positioned underneath the cathodes. The tubular member is in liquid communication with each cathode to collect the molten aluminum therefrom while excluding electrolyte. Molten aluminum is delivered through the tubular member to a molten aluminum reservoir located substantially opposite the anodes and cathodes. The molten aluminum is collected from the cathodes and delivered to the reservoir while avoiding contact of the molten aluminum with the anodic bottom.

In spite of these disclosures, there is still a great need for a cell and method for operating it, which permits the use of a low temperature cell, e.g., in a temperature range of about 700° to 850° C., using a slurry of alumina particles in the electrolyte and recovery of aluminum therefrom without contamination with alumina particles or electrolyte. The present invention provides such a cell and method of operation.

SUMMARY OF THE INVENTION

It is an object of the present invention to provide an improved cathode for use in an electrolytic cell used for producing aluminum from alumina.

It is another object of this invention to provide an improved electrolytic cell for the production of aluminum from alumina.

It is a further object of this invention to provide an improved method for removing molten aluminum from an electrolytic cell used for producing aluminum from alumina.

It is yet another object of this invention to provide an improved process for removing molten aluminum from a low temperature electrolytic cell employing a slurry of alumina in the electrolyte.

It is still another object of this invention to provide a process and apparatus for removing aluminum from an electrolytic cell employing a bottom anode for generating gas bubbles during operation of the electrolytic cell for producing aluminum from alumina.

These and other objects will become apparent from a reading of the specification and claims and an inspection of the drawings appended hereto.

In accordance with these objects, there is provided a method of producing aluminum in an electrolytic cell containing alumina dissolved in the electrolyte, the method comprising the steps of providing a molten salt electrolyte containing an alumina slurry in an electrolytic cell having an anodic liner for containing the electrolyte, the liner having an anodic bottom and walls including at least one end wall extending upwardly from the bottom, the anodic liner being substantially inert with respect to the molten electrolyte. A plurality of non-consumable anodes is disposed substantially vertically in the electrolyte and a plurality of cathodes are is disposed vertically in the electrolyte. The anodes and cathodes are arranged in alternating relationship, and the anodes are electrically connected to the anodic liner. The cathodes have a porous, electrically conductive layer on the surface thereof wet by molten aluminum and suited to deposit aluminum thereon, the porous layer separating the molten aluminum from the electrolyte. An electric current is passed through the anodic liner to the anodes, through the electrolyte to the cathodes, and aluminum is deposited on the cathodes. Oxygen bubbles are generated at the anodes and the anodic liner, the bubbles stirring the electrolyte. Molten aluminum is collected from the cathodes in a tubular member, the tubular member in liquid communication with each cathode to collect molten aluminum therefrom. Molten aluminum is delivered by siphoning through the tubular member to a molten aluminum container.

An integrated cell design for reduction of alumina to aluminum employs copper, nickel, iron alloy anodes and containing vessel with aluminum-wetted cathodes that simultaneously conduct electrical current and aluminum out of the cell. The molten electrolyte, containing a slurry of alumina, is a eutectic composition of $AlF_3$ primarily with NaF but may contain also KF and LiF. Alumina is fed directly into the electrolyte in the cell. The surface of each vertical cathode is a layer of small-pore titanium diboride that admits molten aluminum deposited electrolytically, but excludes electrolyte. The cathode core, an inert porous material that fills with aluminum is attached to an inert supporting pipe that carries the molten aluminum to an inert header pipe that connects to all of the cathodes and siphons the aluminum to a heated holding vessel that is part of the cell. Titanium diboride collector bars carry the cathodic current out of the cell from the header.

DETAILED DESCRIPTION OF PREFERRED EMBODIMENTS

Figure 1:
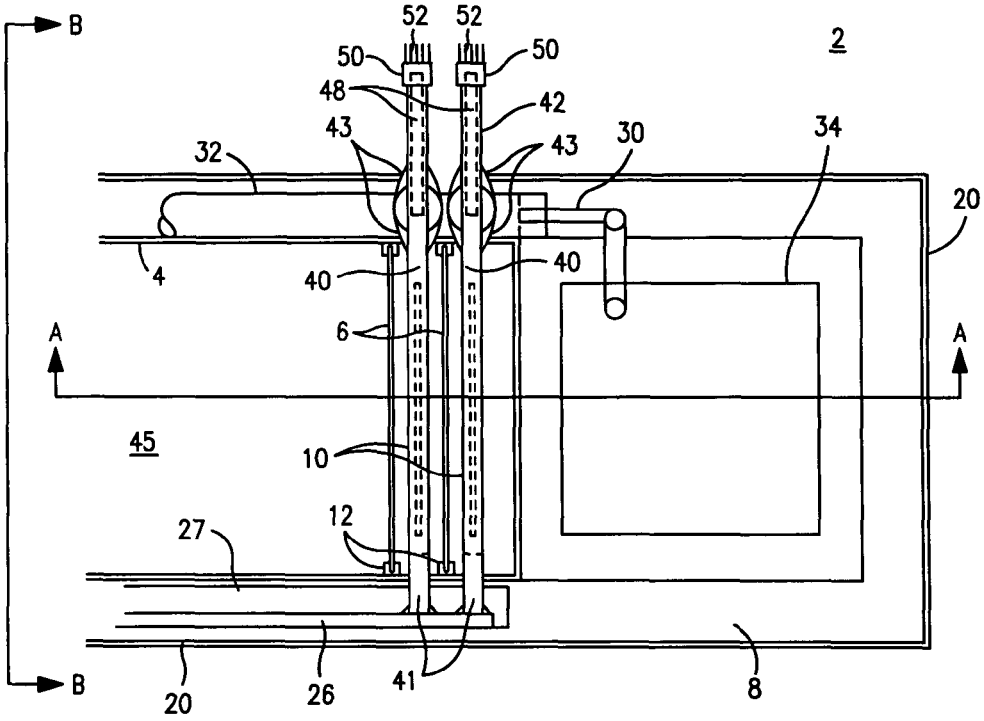
FIG. 1 is a plan view of the cell in accordance with the invention.

In FIG. 1 there is shown a partial top or plan view of an embodiment of the invention which illustrates an electrolytic cell 2 for the electrolytic production of aluminum from alumina dissolved in an electrolyte contained in the cell. Cell 2 comprises a metal or alloy liner 4 having bottom and sides for containing the electrolyte. Nonconsumable or inert anodes 6 are shown mounted vertically inside liner 4, which preferably has the same composition as the liner. Anodes 6 are electrically connected to liner 4, which is electrically connected to a bus bar (not shown). Further, liner 4 is provided with thermal insulation 8 such as insulating brick or mineral wool fiberboard, which are contained within metal shell 20. Cathodes 10 are shown interleafed with anodes 6.

In operation, electric current flows into liner 4, through anodes 6 and through the electrolyte 45 to cathodes 10. The current then flows from cathodes 10 through a bus bar to an adjacent cell.

Inert anodes including cermets or metal alloys may be used in the electrolytic cell. However, preferred anode material comprise Cu—Ni—Fe compositions that have resistance to oxidation in the electrolyte. Suitable compositions are comprised of 10-70 wt. % Cu, 15-35 wt. % Ni and 20-65 wt. % Fe.

Figure 2:
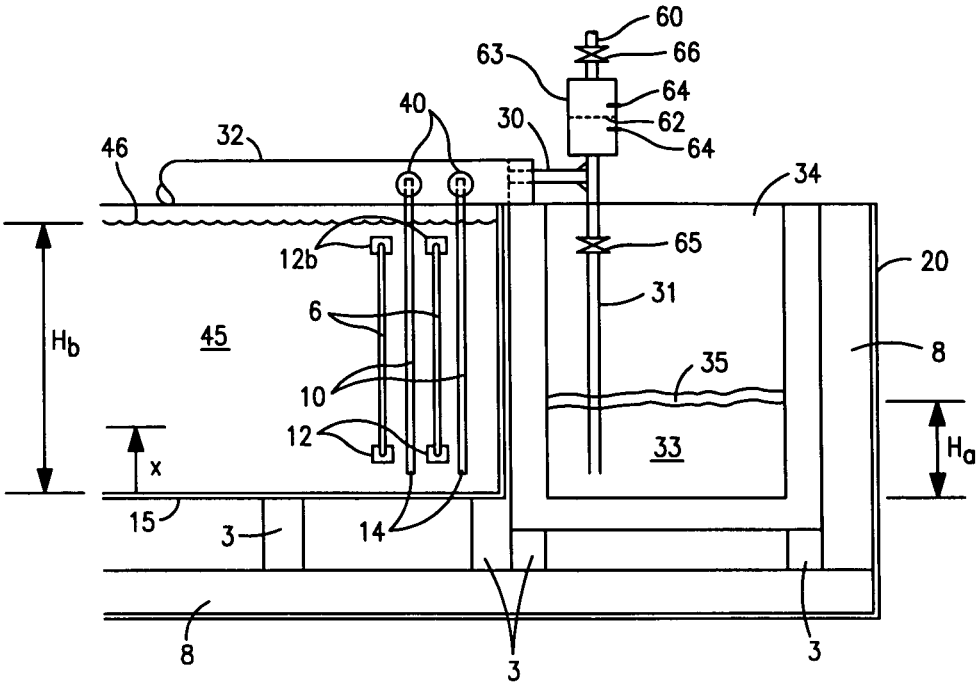
FIG. 2 is a side cross section AA of FIG. 1 showing aluminum in a container in accordance with the invention.

In the plan view in FIG. 1, there is shown a molten aluminum reservoir 34 and a conduit, referred to generally as 30, for conveying molten aluminum from cathodes 10 to reservoir 34, as shown in FIG. 2.

FIG. 2 is a cross-sectional view along the line A-A of FIG. 1. In FIG. 2, molten salt electrolyte 45 is shown having surface 46 with anodes 6 located beneath surface 46 and cathodes 10 extending above surface 46 and connected into conduit 30 for conveying molten aluminum 33 from cathodes 10 to reservoir 34. Molten aluminum 33 in reservoir 34 is covered with a protective layer 35 of molten electrolyte 45 to prevent oxidation. Aluminum may be siphoned from reservoir 34 and carried to the cast house, for example. Cell 2, including the electrolytic cell and molten aluminum reservoir, which is supported by refractory pillars 3, is located within steel shell 20. As noted, a layer of refractory insulation 8 is provided within the steel shell.

Referring again to FIG. 1, as noted, pipe or conduit 30 is provided for transporting molten aluminum to reservoir 34. Also, header pipes 40 are provided on top of cathodes 10 (see also FIGS. 2 and 3) and are introduced to header 32 for introducing molten metal thereto from cathodes 10. Molten aluminum from header 32 is conveyed through pipes 30 and 31 to reservoir 34.

Also, in FIG. 1 anodes 6 extend from one side of anode liner 4 to the other and are fixedly supported on each side in slots in bosses 12 welded to the sides of the anode liner 4. The tops of the anodes 6 are welded to the top bosses **12*b* to make firm electrical connection. In FIG. 2, cathodes 10, having end 14, extend deeper into the cell than anodes 6. The cathode ends 14 extend close, e.g., 2 cm, to anode bottom 15 of the electrolytic cells for purposes of generating oxygen bubbles on anode bottom 15** to prevent settling of alumina particles on the bottom.

In FIG. 1, there is shown means for carrying current from the cathodes to an adjacent cell. The means for carrying current to an adjacent cell comprises an extension 42 of head pipes 40. Suitable current collector bars, e.g., titanium diboride, 48 are projected into extensions 42 and into molten aluminum contained therein. Molten aluminum contained in extensions 42 is available from head pipes 40. Metal caps 50, such as aluminum, are provided on the ends of collector bars 48. Flexible conductors 52, such as aluminum, are connected to caps 50 and conduct current to the adjacent cell. With respect to head pipes 40 and header 32, these are sealed at intersections 43 using a cast refractory, for example, made with an alumina base. Also, header 32 rests on thermal insulation 8 and thus provides support for cathodes 10. On the opposed side of cell 2, there is provided a member 26 which serves to support and space head pipes on an insulating slab 27. This electrically insulating slab 27, which may be made of alumina, rests on the anode bus connection 92 (FIG. 3) and raises the member 26 and the ends of the head pipes 40 to the level on the other side caused by header 32. Insulating plugs 41 seal the ends of the head pipes.

Figure 3:
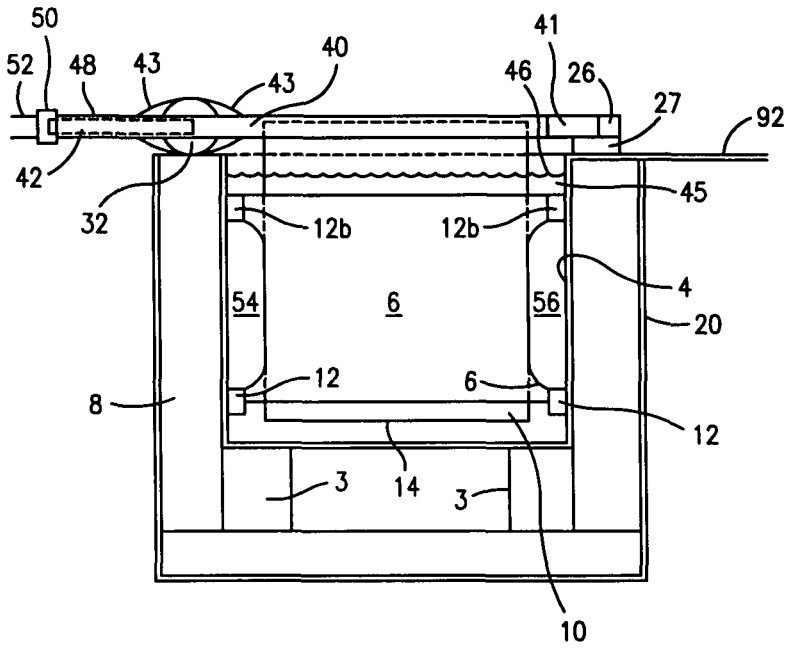
FIG. 3 is an end cross section BB of the cell in accordance with the invention.

With respect to FIG. 3, there is shown a cross-sectional view along the line B-B of FIG. 1. In FIG. 3, there is shown a cut away portion of anode 6. The anode is welded at two areas on the upper bosses **12*b* to the sides of liner 4. This design leaves two openings 54 and 56 between anode 6 and the anodic side wall 4. Openings 54 and 56 are advantageous in permitting longitudinal mixing of electrolyte and alumina particles in the cell. In FIG. 3, cathode 10 has a top portion positioned within head pipes 40 which is used to support the cathode in the cell. Shown in FIG. 3 is the anode bus connection 92** of the same composition as the liner and welded to it.

In accordance with the invention, the cores of cathodes 10 comprise an open-pore porous material that does not dissolve or react with molten aluminum. Porous alumina plates are suitable. The plates are fastened inside head pipes 40. During electrolysis, molten aluminum deposited on the cathode is made to migrate upward into head pipes 40 from where it is conveyed to header 32, into pipe 30 and flows through conduit 31 into reservoir 34. Thus, pipes 30 and 31 connect header 32 to the aluminum reservoir. After startup, molten aluminum flows from header 32 by siphoning. At startup, vacuum is applied through valve 60 (FIG. 2) to start the flow of metal. Thereafter, the flow of metal is maintained by keeping the molten metal depth, $H_a$, below the bath depth, $H_b$, and the molten metal level at 62 between two sensing electrodes 64 connected through an electronic control to valve 66.

Figure 4:
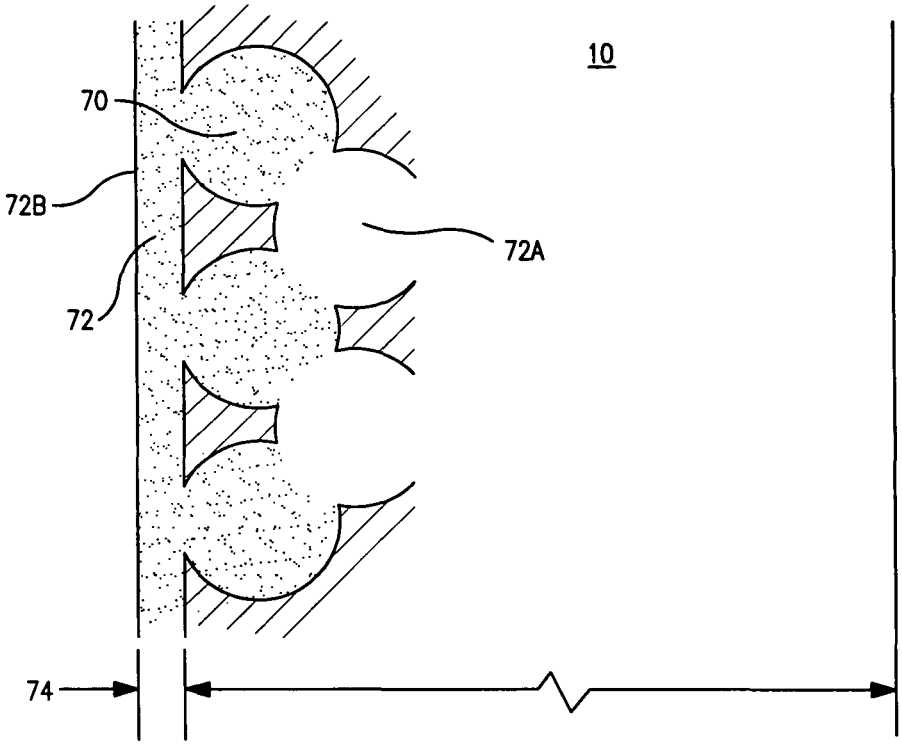
FIG. 4 is a cross-sectional view of an example cathode having coating thereon in accordance with the invention.

As will be seen on FIG. 4, a thin layer 72 of material electrically conductive and resistant to dissolution or reaction with molten aluminum or electrolyte, e.g., comprised of titanium diboride particles applied over the surface of the larger pores 70 in the cathode base. Typically, thin layer 72 has a thickness 74 in the range of 50 to 500 μm, and preferably 100 to 200 μm. After application of the thin layer, the cathode may be sintered at an appropriate temperature and time by established commercial technology. Further, suitable $TiB_2$ particles have a size in the range of typically 5 to 15 μm, which is optimum for this application. The thin layer may be applied by any suitable means such as spreading a paste in a suitable binder. The resulting thin layer of $TiB_2$ has a pore size in the range of 5 to 15 μm. This invention is not limited by this particular method of obtaining a fine-pore aluminum wetting surface on the porous cathode 40. For example, a thin, fine-pore alumina surface layer may be bonded to a porous alumina cathode base 40. The thin layer may be vapor deposited with thin titanium diboride or other inert, aluminum wetting material that does not clog the fine pores. That is, thin layer 72 may comprise several coatings of the same or different electrical conductive material inert with respect to aluminum or electrolyte, and such is contemplated within the invention. One material may be electrical conductive and one not electrical conductive, as long as the overall thin layer is electrical conductive.

In accordance with the present invention, cathodes 10 are comprised of a base of porous alumina or other material not soluble or reactive with molten aluminum having a pore population of up to 100 ppi (pores per inch). Commercial porous alumina plates have pores that are applicable, up to 50 ppi. These pores have a diameter of not greater than 500 μm and preferably less than 500 μm in diameter. For commercial application, the cathode preferably has thickness in the range of 1 to 2.5 cm. Pores 70 which have a spherical configuration are illustrated in FIG. 4. It should be understood that alumina by itself is not an electrical conductor, but an open-pore body of alumina becomes an excellent electrical conductor when filled with molten aluminum.

The thin, aluminum wetted layer is important to the cathode because it operates to separate alumina particles and electrolyte from molten aluminum deposited on the cathode. Without this layer, the fluoride electrolyte would preferentially wet the porous alumina and exclude molten aluminum. The $TiB_2$ layer is wettable by the molten aluminum deposited thereon during electrolysis, thereby permitting only molten aluminum to pass therethrough. Alumina particles and electrolyte are rejected by the thin layer of $TiB_2$, thereby providing separation.

Figure 8:
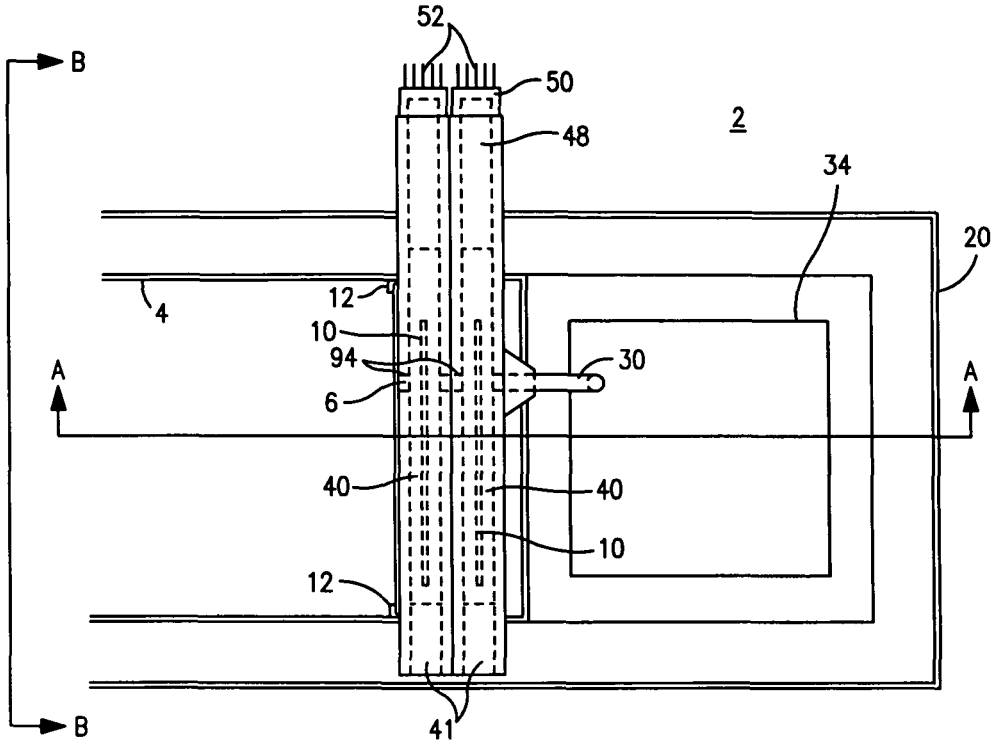
FIG. 8 is a view similar to FIG. 1 showing another embodiment of the invention.

FIG. 8 is a top view of another embodiment of the invention. FIG. 8 is similar to FIG. 1 except for the removal of aluminum from the cathode head pipes 40. In this embodiment, header 32 and the support and space member 26 (FIG. 1) are eliminated. Cathode head pipes 40 are connected towards the middle of the cell using openings 94 in FIGS. 5 and 8. All the openings may be provided in a straight line, as shown in FIG. 8, or they may be staggered. Vacuum pipe or conduit 30 is fastened into the last head pipe to remove molten aluminum from all the cathode head pipes in the cell. All the head pipes 40 may be bonded together to form a rigid structure by which the cathodes are supported. Thus, all the cathodes can be precisely interleafed in alternating relationship with the anodes.

Figure 5:
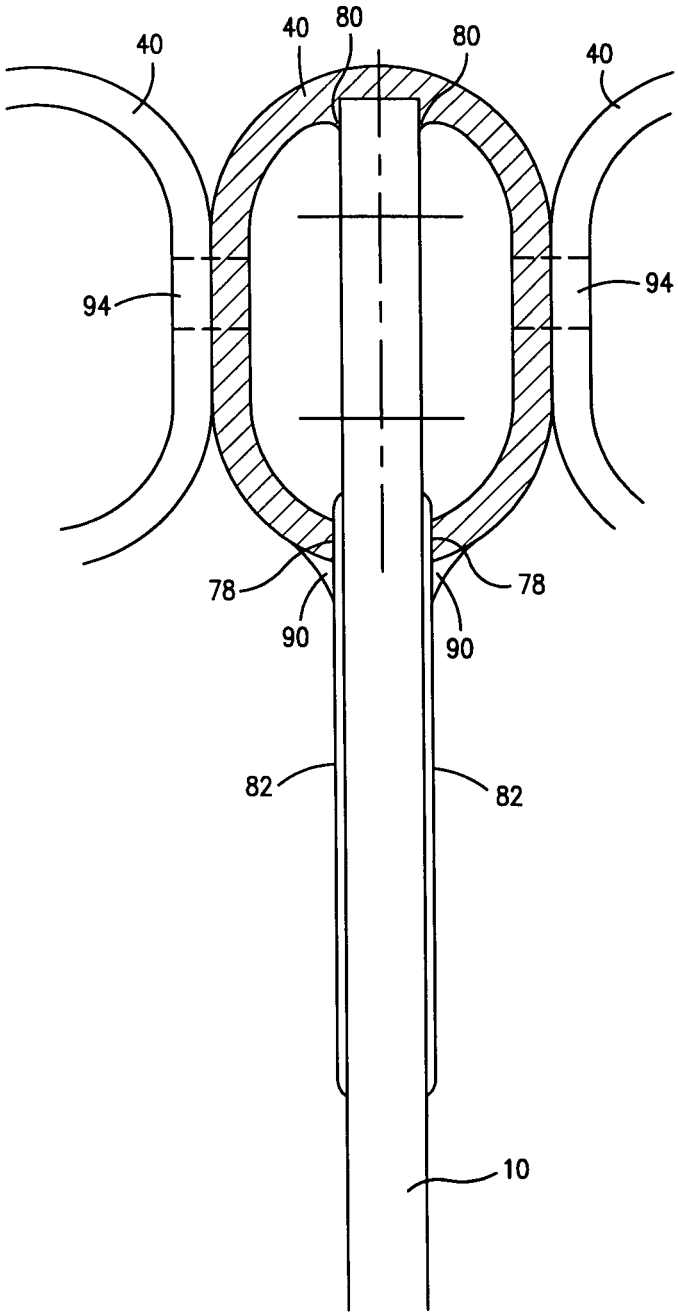
FIG. 5 illustrates a section of an alumina pipe supporting a cathode.

As noted earlier, cathodes 10 are fastened to head pipes 40. Head pipes 40 are specially designed to space the cathodes in alternating arrangement with the anodes. In FIG. 5, the cathodes 10 are shown fitted through a slot having sides 78 and inserted into head pipe 40 to anchor in a receiver or groove 80. Cathode 10 has a portion thereof extending above electrolyte surface 46 having a protective coating 82 thereon to prevent burning of the $TiB_2$ surface coating on the cathode in oxygen above the electrolyte. The protective coating can be comprised of a fused vitreous alumina coating or other similar coating which prevents burning of the $TiB_2$ cathode surface during operation of the cell. When the cathode is anchored in head pipe. 40, it is restrained from moving, and therefore maintains a uniform anode-cathode distance. Additional or adjacent tubes 40 may be used as spacers to restrain the cathode containing pipe from moving. The cathode may be anchored or fastened in head pipes 40 using an appropriate commercially available cast refractory 90 which also operates to seal cathode 10 in head pipe 40. The vitreous coating of alumina does not dissolve because the molten electrolyte contains a slurry or has an excess of soluble particles of alumina. The particles have a greater solubility level than the vitreous alumina coating in the electrolyte and thus the vitreous alumina coating does not dissolve.

The height of the electrolyte, $H_b$, and the height of the aluminum, $H_a$, in the aluminum holding vessel 34 are referenced to the level of the bottom 15 of the alloy vessel in FIG. 2. There is a maximum level for $H_a$ that must not be exceeded to avoid molten aluminum dripping off the cathodes 10. This can happen if there is not enough pressure in the bath to force the molten aluminum deposited on cathode 10 into the cathodes. The maximum level $H_a$ of aluminum is defined by the formula: $H_a=(\rho_b/\rho_a)H_b$. For $\rho_b=2.1$ g/cm$^3$ and $\rho_a=2.36$ g/cm$^3$, $H_a$ is 89% of $H_b$.

Figure 6:
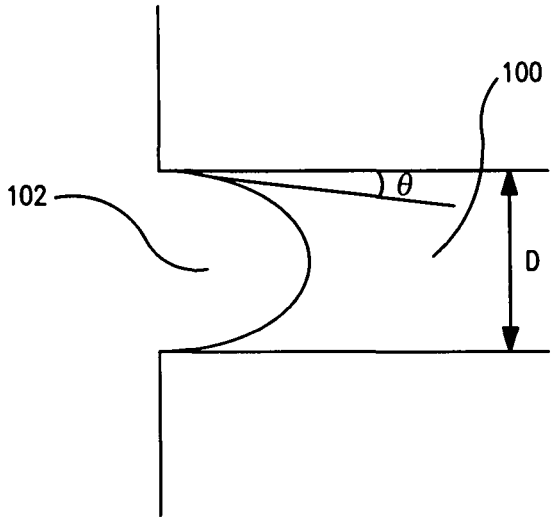
FIG. 6 is a sketch illustrating the pressure balance in a pore of the titanium diboride layer for excluding bath.

In the case where $H_a=0$, the fine pore titanium diboride surface layer 72 in FIG. 4 at the bottom of the cathodes must exclude penetration of electrolyte. FIG. 6 illustrates a pore 100 in the titanium diboride layer and the effect of the electrolyte. Electrolyte is pushed into mouth 102 of the pore by the pressure P, which is then equal to $H_b\,\rho_b$. The force on the opening into the pore is defined by the formula $F_p=(\pi D^2/4)P$. This force is resisted by the interfacial tension force of electrolyte-aluminum, which is defined by the formula $F_\gamma=\pi D\gamma \cos\theta$. When $\cos\theta=1$, breakthrough of electrolyte into the pore would occur when the two forces are equal, which gives $D=4\gamma/P$. A value of $\gamma=800$ mN/m and a 30 cm bath depth giving (30)(2.1)=63 g/cm$^2$, results in D=520 μm. This value is about 50 times the diameter of pores that form from sintering 10 μm titanium diboride particles. Thus, there is no electrolyte or bath penetration into the titanium diboride surface layer on the cathodes.

A lower limit to the pore size in the titanium diboride layer on the cathodes is the case in which the bath pressure at the bottom of the cathode is not sufficient to force the flow of cathodically deposited aluminum through the surface layer of titanium diboride. The pressure across the titanium diboride layer is $\Delta P_x=(H_b-x)\rho_b-(H_a-x)\rho_a$ in which $H_b$, $H_a$ and x are defined in FIG. 2. As an example, $H_b$ may be 35 cm and the maximum $H_a$ is 89% of that, or 31 cm. For safe operating condition the level of $H_a$ may be 5 cm lower, or 26 cm. The value of $\Delta P_x$ at the bottom of a cathode which is 2 cm above the cell bottom is then 12.7 g/cm$^2$. Flow of a liquid such as aluminum through a porous body such as the sintered titanium diboride layer is as follows: $\Delta P=\mu VL/kg_c$. Values of the right hand parameters are:

μ (viscosity)=0.022 g/cm·s for molten aluminum at 750° C.

V (velocity=(0.5)(27)/(3)(96,500)(2.36)=2.0×10$^5$ cm/s at 0.5 A/cm$^2$ in Faraday's Law L (thickness)=0.05 cm in FIG. 4

$g_c$ (gravitational constant)=981 cm/s$^2$

Flow through porous media has the values of k=(6.54×10$^{-4}$) d$^2$ for small-diameter, d, close-packed spherical particles. For sintered metals, which have smaller and more tortuous pores, values for k are more than ten times larger. The smallest value of d to meet these conditions is then d=[(0.022)(2.0×10$^{-5}$)(0.05)/(12.7)(981)(10)(6:54×10$^{-4}$)]$^{1/2}$=1.6×10$^{-5}$ cm, or 0.16 μm.

The commercial 10 μm titanium diboride particles for sintering on the surface of the porous alumina cathode substrates are approximately half way in size on a logarithmic scale between the minimum 0.16 μm for molten aluminum flow and the maximum 520 μm for avoiding bath penetration giving a large margin of operability.

The design of the titanium diboride collector bars 48 in FIG. 1 has special requirements. The $TiB_2$ collector bars must have an electrical resistance such that heat generated by the current in them produces a zero, or close to zero, temperature gradient at the hot end so that heat is not removed, thus avoiding freezing the aluminum in the alumina header. For the condition of no side heat loss with good thermal insulation surrounding the bars, the current required for zero temperature gradient at the inboard end is $I_0$=2.89 (A/L)[$t_1-t_0$)) K/$\rho_0$]$^{1/2}$ in which A is the cross section area of the bar in cm$^2$, L is the length in cm, $t_1$ and $t_0$ are the inboard and outboard temperatures in ° C., K is the thermal conductivity of titanium diboride at 0.06 cal/s cm ° C. and $\rho_0$ its resistivity at 50×10$^{-6}$ Ωcm. The current to the two active sides of the cathodes at 0.5 A/cm$^2$ is (2)(0.5)(30)(60)=1800 A is $I_0$. The value of $t_1$ is 750° C. and that of $t_0$ is assumed to be designed for 350° C. at the interconnecting bus between cells. These parameters give A/L=0.90 cm. For the titanium diboride collector bar filling the full cross section of the cathode head pipe in FIG. 5 of 16 cm$^2$, the length of the titanium diboride collector bar should be 18 cm. The voltage drop in the collector bar is E=2.89 [($t_1-t_0$)K$\rho_0$]$^{1/2}$ which for the above parameters gives 0.10 volt. Cracking of the alumina sleeve around the titanium diboride collector bar by temperature increase at startup is usually without problem because values for their thermal expansion coefficients are similar. Conventional, natural-convection, heat transfer design for an intermediate bus bar for the connections to the anode tab 92, in FIG. 3 and the flexible aluminum conductors 52 in FIG. 1 can be made to obtain the design temperature for the aluminum cap 50 on the titanium diboride collector bar.

The voltage drop in the vertical cathodes may be calculated as follows: The approximate cross section of a one cm thick base for electrical conduction is (1)(60)=60 cm$^2$ and the total conducting path is about 35 cm. Assuming the alumina porosity is about 0.5, the average path of the current is ½ the height, a resistivity of 22×10$^{-6}$ Ωcm for molten aluminum at 750° C. and a total current of 1800 A then gives a voltage drop of (1800)(22×10$^{-6}$)(35)/(60)(0.5)(2)≈0.025 V. The voltage drop in the alumina head pipe at the top of a cathode with 16 cm$^2$ cross section of aluminum and a conducting length of about 65 cm is about (1800)(22×10$^6$)(65)/(2)(16)≈0.08 V.

Figure 7:
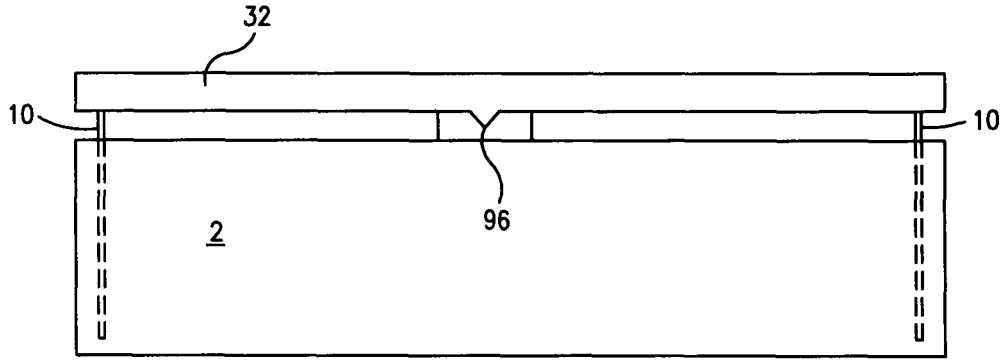
FIG. 7 is a diagram illustrating means for pinning the cathode assembly at the center of the cell.

In the present invention, for example, the length of a production cell is limited by the differential expansion of the alloy cell liner and the alumina header 32 or the bonded head pipes (FIG. 8) holding the cathodes at startup. The initial temperature on startup is about 20° C. and the final operating temperature is about 750° C. The expansion coefficient of the Cu:Ni:Fe alloy is about 13×10$^{-6}$/° C. and that of fused alumina about 7×10$^{-6}$/° C., giving a differential of about 6×10$^{-6}$/° C. The ΔL for the cell on startup is then (750−20)(6×10$^{-6}$)L=0.0044 L. At operating temperature, a uniform anode-cathode distance is needed for the whole cell, requiring a non-uniform anode-cathode distance when the cell is at room temperature. The problem can be reduced by half by pinning the midpoints 96 of the alloy cell vessel and alumina header as shown in FIG. 7. If 0.5 cm change in ACD is allowed at each end at startup, then ½ L=0.5/0.0044=114 cm or the total cell length is 228 cm. For a center to center spacing of cathodes equal to 4 cm, the number of cathodes is 228/4=57 and the total cell or line current is (1800)(57)≈100,000 amperes.

The rate of heat generation in cell 2 is considerably less than for a similar capacity Hall cell, thus it is important that the cell be well insulated. The thermodynamic potential to produce aluminum by the reaction, $Al_2O_3$=2 Al+3/2 $0_2$, is 2.35 V at 750° C. The thermodynamic potential for the heat of reaction for this reaction at the same temperature is 2.92 V. At a cell voltage below 2.92 V, heat must be supplied to the cell to keep it at operating temperature. At a cell voltage above 2.92 V, heat is generated for self sustaining operation. At a current density of 0.5 A/cm$^2$, the cell voltage is 3.5 V and the thermal efficiency is (2.92/3.5)×100=83%. For a 100,000 ampere cell, the heat generated at 0.5 A/cm$^2$ is (100,000)(3.5−2.92)/(1000)=58 kW.

In the present invention, there is a hot region of the cell that is required to be insulated. The size of this hot region may be calculated as follows. For example, the cell length is 228 cm/30.5 (cm/ft) which is equal to 7.5 ft. About 2.5 additional feet are required for the aluminum collection vessel, which make a total for the cell of about 10 ft. The height of the cell from the bottom of the supporting piers 3 to the top of the alumina header is about 2.5 ft (see FIG. 2). The width of the cell is also about 2.5 ft (see FIG. 3). The inside area of the insulation is then (10)(4×2.5)+(2)(2.5×2.5)=112.5 ft$^2$. Using a thermal conductivity of 0.05 Btu/hr ft$^2$(° F./ft) for a three inch thick commercial mineral wool fiberboard at a mean temperature in the board of 800° F. and assuming a temperature difference of (750−100)(1.8)=1170° F., the heat transferred is then (0.05)(112.5)(1170)/(3/12)=26,300 Btu/hr or 7.7 kW. This is the heat that must be supplied during a power outage to keep the cell at temperature, plus heat supplied at the titanium diboride collector bars. It may be noted that unlike a Hall cell, there is no electrolyte penetration into the thermal insulation, and thus the thermal characteristics do not change with time.

The amount of heat to be removed by cooling air under the cell vessel during normal operation is 58-7.7≈50 kW.

One of the problems with the Cu:Ni:Fe alloy cell vessel is air oxidation on the outside causes continued growth in oxide thickness and flaking of the oxide. Inside the cell there is continuous slow dissolution of Cu:Ni:Fe liner by the molten electrolyte. Thus, it has been discovered that the outside of the vessel may be protected by baking on a commercial glass enamel.

Alumina can be fed on a continuous basis into the cell by an alumina feeder controlled by a cell control system. The cell can be completely sealed and oxygen produced can be collected into a gas header on top of the cell (not shown).

In startup of a single cell, the individual cathodes 10 are covered with aluminum, for example, by wrapping with aluminum foil to avoid molten bath contact with the porous titanium diboride surface. The cathode assembly is then lowered into the cell and cathode current leads connected. Powdered bath of correct composition is loaded into the cell. Small pigs of aluminum are loaded into the aluminum tapping reservoir 34. Heat may be applied underneath the cell and reservoir by gas burners (not shown). Additional powdered bath is added to the cell as melting progresses to bring the surface up to the operating level. The aluminum foil melts before the bath and wets the titanium diboride surface on the cathodes 10.

When the molten bath reaches operating temperature, the valve 65 in pipe 31 in FIG. 2 is closed and a vacuum is applied to the aluminum level control reservoir 63 in FIG. 2 which causes a substantial removal of air from pipe 30, header 32, head pipes 40 and porous cathodes 10. Valve 66 is closed and valve 65 is then slowly opened to pull molten aluminum 33 in the reservoir 35 into the aluminum header 32, head pipes 40 and the cores of the porous cathodes 10. The molten aluminum contacts inner surfaces 72A of the titanium diboride layer 72 on the porous core of the cathodes and the titanium diboride collector bars 48. When the titanium diboride surface layers on the cathodes are wet by molten aluminum, a low current is applied to the cell which electrolytically deposits molten aluminum on cathode surfaces 72B. The deposited aluminum on the cathode surfaces flows into the porous cathodes under bath pressure. Any remaining entrapped air reacts with the molten aluminum to form minor amounts of aluminum oxide and aluminum nitride that are not significant. The electric current is slowly ramped up to line current. When the cell reaches line current the gas heating is turned off and the cell is cooled by air flow under the lining 4. A line of cells can be started in this way with the line power source. For starting a single cell, a portable auxiliary power source may be used to bring the cell to line current. The cell is then disconnected from the auxiliary source and connected to line current.

In the event of a power failure, gas heat may be applied under the linings 4 in the cells and on the inboard ends of the titanium diboride collector bars.

Having described the presently preferred embodiments, it is to be understood that the invention may be otherwise embodied within the scope of the appended claims.

What is claimed is:

1. A method of producing aluminum in an electrolytic cell containing alumina dissolved in the electrolyte, the method comprising the steps of:

(a) providing a molten salt electrolyte having dissolved alumina and excess of alumina particles as a slurry therein in an electrolytic cell having an anodic liner for containing said electrolyte, said liner having an anodic bottom and walls including at least one end wall extending upwardly from said bottom, said anodic liner being substantially inert with respect to said molten electrolyte;

(b) providing a plurality of non-consumable anodes disposed substantially vertically in said electrolyte and a plurality of cathodes disposed vertically in said electrolyte, said anodes and said cathodes arranged in alternating relationship, said anodes electrically connected to said anodic liner, said cathodes comprised of a porous base suitable for passing molten aluminum therethrough, said porous base material having a micro-porous, electrically conductive layer on the surface thereof wet by molten aluminum and suited for depositing aluminum thereon and for separating said molten aluminum from said molten electrolyte during operation of the cell;

(c) passing an electric current through said anodic liner to said anodes, through said electrolyte to said cathodes, depositing aluminum on said cathodes, and generating oxygen bubbles at the anodes and said anodic liner, said bubbles stirring said electrolyte;

(d) passing molten aluminum through said porous base comprising said cathode;

(e) collecting molten aluminum from said cathodes in a tubular member, said tubular member in liquid communication with each cathode to collect molten aluminum therefrom; and (f) delivering molten aluminum by siphoning through said tubular member to a molten aluminum container.

2. The method in accordance with claim 1 wherein the micro-porous cathode layer has a pore size in the range of 0.2 to 500 μm.

3. The method in accordance with claim 1 wherein the micro-porous cathode layer has a pore size in the range of 2 to 100 μm.

4. The method in accordance with claim 1 wherein the micro-porous cathode layer has a thickness in the range of 50 to 1000 μm.

5. The method in accordance with claim 1 wherein the micro-porous cathode layer has a thickness in the range of 100 to 200 μm.

6. The method in accordance with claim 1 wherein the micro-porous cathode layer is comprised of a material selected from the group consisting of titanium diboride, titanium carbide, zirconium carbide, zirconium boride, mixtures thereof and molybdenum.

7. The method in accordance with claim 1 wherein the micro-porous cathode layer is comprised of titanium diboride.

8. The method in accordance with claim 1 wherein the micro-porous cathode layer is comprised of titanium carbide.

9. The method in accordance with claim 1 wherein, said base is comprised of an open-pore material substantially inert to molten aluminum.

10. The method in accordance with claim 1 wherein, said base is comprised of open-pore alumina.

11. The method in accordance with claim 1 wherein said cathode base has pores having a pore size in the range of 100 to 500 μm.

12. The method in accordance with claim 1 wherein said cathode base has pores having a pore size in the range of 200 to 300 μm.

13. The method in accordance with claim 1 wherein said base layer has pores having a diameter larger than a pore diameter of said micro-porous layer.

14. The method in accordance with claim 1 wherein said anodes and anodic liner are comprised of an alloy of copper, nickel and iron.

15. The method in accordance with claim 1 wherein said electrolyte is a eutectic of $AlF_3$ and NaF generally operating at a temperature of 700° to 850° C.

16. A method for operating an electrolytic cell containing alumina dissolved in a molten electrolyte for producing aluminum, the cell having an anodic liner and a plurality of anodes and cathodes immersed in said electrolyte, the improved method comprising providing a porous cathode base having a micro-porous, electrical conducting layer on the surface thereof, said layer substantially inert to and wettable by molten aluminum and suited for depositing aluminum thereon when electric current is passed from the anode to the cathode, said micro-porous layer adapted for separating molten aluminum from electrolyte and permitting passage of aluminum therethrough and through said porous cathode base for collection.

17. The method in accordance with claim 16 wherein the a micro-porous layer has a pore size in the range of 0.2 to 500 μm.

18. The method in accordance with claim 16 wherein the a micro-porous layer has a pore size in the range of 2 to 100 μm.

19. The method in accordance with claim 16 wherein the a micro-porous layer has a thickness in the range of 50 to 1000 μm.

20. The method in accordance with claim 16 wherein the micro-porous layer has a thickness in the range of 100 to 200 μm.

21. The method in accordance with claim 16 wherein the micro-porous layer is comprised of a material selected from the group consisting of titanium diboride, titanium carbide, zirconium carbide, zirconium boride, mixtures thereof and molybdenum.

22. The method in accordance with claim 16 wherein the micro-porous layer is comprised of titanium diboride.

23. The method in accordance with claim 16 wherein the micro-porous layer is comprised of titanium carbide.

24. The method in accordance with claim 16 wherein the cathode having the porous base for coating said micro-porous layer thereon is comprised of a material substantially inert to molten aluminum.

25. The method in accordance with claim 16 wherein the cathode having the porous base for coating said micro-porous layer thereon is comprised of alumina.

26. The method in accordance with claim 16 wherein said cathode base has pores having a pore size in the range of 100 to 500 μm.

27. The method in accordance with claim 16 wherein said cathode base has pores having a pore size in the range of 200 to 300 μm.

28. A system for producing aluminum in an electrolytic cell having a molten electrolyte containing alumina dissolved therein, the system comprised of:

(a) an electrolytic cell having an anodic liner for containing a molten salt electrolyte having alumina dissolved therein, said liner having an anodic bottom and walls including at least one end wall extending upwardly from said bottom, said anodic liner being substantially inert with respect to said molten electrolyte;

(b) a plurality of non-consumable anodes and a plurality of cathodes disposed in said cell, said cathodes comprised of a porous electrical conductive surface layer provided on a porous base for passing molten aluminum therethrough, the surface layer suited for depositing aluminum thereon and for separating aluminum from said electrolyte;

(c) means for passing an electric current through said anodic liner to said anodes, through said electrolyte to said cathodes, in response to passing electric current through said electrolyte, depositing aluminum on said surface layer of said cathodes, and generating oxygen bubbles at the anodes and said anodic liner, said bubbles stirring said electrolyte;

(d) a tubular member in liquid communication with the porous base of each cathode to collect molten aluminum therefrom; and (e) means for delivering molten aluminum through said tubular member to a molten aluminum container.

29. The system in accordance with claim 28 wherein said surface layer has a pore size in the range of 0.2 to 500 μm.

30. The system in accordance with claim 28 wherein said surface layer has a pore size in the range of 2 to 100 μm.

31. The system in accordance with claim 28 wherein said surface layer has a thickness in the range of 50 to 500 μm.

32. The system in accordance with claim 28 wherein said surface layer has a thickness in the range of 100 to 200 μm.

33. The system in accordance with claim 28 wherein said surface layer is comprised of a material selected from the group consisting of titanium diboride, titanium carbide, zirconium carbide, zirconium boride, mixtures thereof and molybdenum.

34. The system in accordance with claim 28 wherein said surface layer is comprised of titanium diboride.

35. The system in accordance with claim 28 wherein said surface layer is comprised of titanium carbide.

36. The system in accordance with claim 28 wherein said porous base for coating with said surface layer is comprised of a material substantially inert to molten aluminum.

37. The system in accordance with claim 28 wherein said porous base for coating with said surface layer is comprised of alumina.

38. The system in accordance with claim 28 wherein said cathode base has pores having a pore size in the range of 100 to 500 μm.

39. The system in accordance with claim 28 wherein said cathode base has pores having a pore size in the range of 200 to 300 μm.

40. The system in accordance with claim 28 wherein electrically-conducting current collector bars, substantially inert to molten aluminum, are provided in said tubular member conducting the molten aluminum from the cathodes to the molten aluminum container, the collector bars designed to remove current from the cell.

41. The system in accordance with claim 28 wherein the electrically-conducting collector bars are titanium diboride.

42. The system in accordance with claim 28 wherein the cell is thermally insulated and has active temperature control.

43. The system in accordance with claim 28 wherein electrical or flame heat is provided under and around the cell to bring the cell to operating temperature.

44. The system in accordance with claim 28 wherein air flow is provided under and around the cell liner to remove excess heat during operation.

45. An electrolytic cell containing alumina dissolved in a molten electrolyte for producing aluminum, the cell having an anodic liner and a plurality of anodes and cathodes immersed in said electrolyte, the improvement comprising a cathode having a porous base suitable for passing molten aluminum therethrough and having a micro-porous, electrical conducting layer on a surface of the porous base, said layer wettable by molten aluminum and adapted to deposit aluminum thereon when electric current is passed from the anode to the cathode, said micro-porous layer adapted for separating molten aluminum from electrolyte and permitting passage of aluminum therethrough and through said porous base for collection.

46. The cell in accordance with claim 45 wherein said micro-porous layer has a pore size in the range of 0.2 to 500 μm.

47. The cell in accordance with claim 45 wherein said micro-porous layer has a pore size in the range of 2 to 100 μm.

48. The cell in accordance with claim 45 wherein said micro-porous layer has a thickness in the range of 50 to 500 μm.

49. The cell in accordance with claim 45 wherein said micro-porous layer has a thickness in the range of 100 to 200 μm.

50. The cell in accordance with claim 45 wherein said micro-porous layer is comprised of a material selected from the group consisting of titanium diboride, titanium carbide, zirconium carbide, zirconium boride, mixtures thereof and molybdenum.

51. The cell in accordance with claim 45 wherein said micro-porous layer is comprised of titanium diboride.

52. The cell in accordance with claim 45 wherein said micro-porous layer is comprised of titanium carbide.

53. The cell in accordance with claim 45 wherein said base for coating said micro-porous layer thereon is comprised of an open-pore material substantially inert to molten aluminum.

54. The cell in accordance with claim 45 wherein said base for coating said micro-porous layer thereon is comprised of alumina.

55. The method in accordance with claim 45 wherein said cathode base has pores having a pore size in the range of 100 to 500 μm.

56. The method in accordance with claim 45 wherein said cathode base has pores having a pore size in the range of 200 to 300 μm.

* * * * *